US007472523B2

(12) United States Patent
Beck

(10) Patent No.: US 7,472,523 B2
(45) Date of Patent: Jan. 6, 2009

(54) RAINSCREEN CLAPBOARD SIDING

(75) Inventor: David Herbert Beck, Jackson, MI (US)

(73) Assignee: Certainteed Corporation, Valley Forge, PA (US)

( * ) Notice: Subject to any disclaimer, the term of this patent is extended or adjusted under 35 U.S.C. 154(b) by 129 days.

(21) Appl. No.: 11/468,585

(22) Filed: Aug. 30, 2006

(65) Prior Publication Data

US 2007/0074483 A1 Apr. 5, 2007

Related U.S. Application Data

(62) Division of application No. 10/407,127, filed on Apr. 3, 2003, now Pat. No. 7,117,651.

(51) Int. Cl.
*E04B 1/00* (2006.01)

(52) U.S. Cl. ..... 52/748.1

(58) Field of Classification Search ..... 52/748.1, 52/741.1, 553, 302.3, 302.1, 518, 558
See application file for complete search history.

(56) References Cited

U.S. PATENT DOCUMENTS

| | | | |
|---|---|---|---|
| 1,424,566 | A | 8/1922 | Griffiths |
| 1,510,497 | A | 7/1924 | Keller |
| 1,978,519 | A | 10/1934 | Willock et al. |
| 2,009,617 | A | 7/1935 | Harshberger |
| 2,182,372 | A | 12/1939 | Cox et al. |
| 2,323,230 | A | 6/1943 | McAvoy |
| 2,517,122 | A | 1/1950 | Lockwood |
| 2,511,083 | A | 6/1950 | Small |
| 2,624,298 | A | 1/1953 | Farren |
| 2,724,872 | A | 11/1955 | Herbes |
| 2,928,143 | A | 3/1960 | Newton |
| 3,660,955 | A | 5/1972 | Simon |

(Continued)

FOREIGN PATENT DOCUMENTS

AU 98885 S 3/1987

(Continued)

OTHER PUBLICATIONS

"Standard Test Methods of Conducting Strength Tests of Panels for Building Contruction," ASTM, Designation: E72-98, ASTM, Jun. 1998, pp. 539-549.

(Continued)

*Primary Examiner*—Milton Nelson, Jr.
(74) *Attorney, Agent, or Firm*—Duane Morris LLP

(57) ABSTRACT

A generally rectangular siding panel having a front and rear faces is provided. The siding panel has at least one protrusion disposed along at least one of the faces, wherein the at least one protrusion provides an air gap between the siding panel and a face of a second siding panel when the siding panels are installed in a siding panel assembly. A generally rectangular siding panel having a front and rear faces is also provider where the siding panel has at least one recess or cut spaced along at least one of the faces, wherein the at least one recess or cut provides an air flow path between the siding panel and a face of a second siding panel when the siding panels are installed in a siding panel assembly.

21 Claims, 8 Drawing Sheets

U.S. PATENT DOCUMENTS

| | | | | | |
|---|---|---|---|---|---|
| 3,771,271 | A | * | 11/1973 | Keel | 52/478 |
| 3,797,179 | A | | 3/1974 | Jackson | |
| 3,818,668 | A | | 6/1974 | Charniga | |
| 3,992,845 | A | | 11/1976 | Grzesiek et al. | |
| 4,070,843 | A | | 1/1978 | Leggiere et al. | |
| 4,079,562 | A | | 3/1978 | Englert et al. | |
| 4,278,071 | A | | 7/1981 | Brill-Edwards | |
| 4,288,959 | A | | 9/1981 | Murdock | |
| 4,698,942 | A | | 10/1987 | Swartz | |
| 4,712,351 | A | | 12/1987 | Kasprzak | |
| 4,754,589 | A | | 7/1988 | Leth | |
| 4,788,808 | A | * | 12/1988 | Slocum | 52/521 |
| 4,854,101 | A | | 8/1989 | Champagne | |
| 5,224,318 | A | * | 7/1993 | Kemerer | 52/521 |
| 5,305,570 | A | | 4/1994 | Rodriguez et al. | |
| 5,361,551 | A | | 11/1994 | Post | |
| 5,388,381 | A | | 2/1995 | Bilinski et al. | |
| 5,410,852 | A | | 5/1995 | Edgar et al. | |
| 5,564,245 | A | | 10/1996 | Rademacher | |
| 5,634,314 | A | | 6/1997 | Champagne | |
| 5,675,955 | A | | 10/1997 | Champagne | |
| 6,138,430 | A | | 10/2000 | Van Acoleyen et al. | |
| 6,276,107 | B1 | | 8/2001 | Waggoner et al. | |
| 6,319,456 | B1 | | 11/2001 | Gilbert et al. | |
| 6,363,676 | B1 | | 4/2002 | Martion, III | |
| 6,367,220 | B1 | | 4/2002 | Krause et al. | |
| 6,526,717 | B2 | | 3/2003 | Waggoner et al. | |
| 6,635,218 | B2 | | 10/2003 | King | |
| 6,737,008 | B2 | | 5/2004 | Gilbert et al. | |
| 2002/0023366 | A1 | | 2/2002 | Bueno | |

FOREIGN PATENT DOCUMENTS

| | | |
|---|---|---|
| JP | 06093685 | 4/1992 |
| JP | 04333749 | 11/1992 |
| JP | 04333750 | 11/1992 |

OTHER PUBLICATIONS

Lstiburek, Joseph, "Water-Managed Wall Systems," Journal of Light Construction, Mar. 2003.

International Search Report for corresponding PCT Application No. PCT/US04/10242, dated Apr. 7, 2005.

* cited by examiner

RAINSCREEN CLAPBOARD SIDING

CROSS-REFERENCE TO RELATED APPLICATION

The present application is a divisional application of U.S. patent application Ser. No. 10/407,127, filed Mar. 3, 2003 now U.S. Pat. No. 7,117,651, the entirety of which is hereby incorporated by reference herein.

FIELD OF THE INVENTION

The present invention relates to siding products and methods of installing siding products, and more particularly to apparatuses and methods for providing rainscreen in overlapping siding panels.

BACKGROUND OF THE INVENTION

Typically, clapboard siding panels, such as fiber cement clapboard siding panels, are installed on a wall of a structure, generally on a sheathing product, in one of two ways—either in a so called "blind nail" method or a so called "face nail" method. In the blind nail method, illustrated by siding panel assembly 20 of FIG. 2, a first siding panel 16*a* is aligned on the face of a wall 12 and a nail (not shown) is driven through the panel 16*a*, generally through an upper region of the exterior face of the panel 16*a*, into the wall 12. A second panel 16*b* is then secured to the wall 12 in the same manner using nail 18. The second panel 16*b* overlaps a portion of the exterior face of the first panel 16*a* and covers the nail or fastener driven through the first panel 16*a*. Another panel (not shown) is then installed overlapping panel 16*b* and covering nail 18. The blind nail method, although aesthetically pleasing, generally provides less wind load resistance (i.e., resistance to detachment from the wall under wind load), when compared with the face nail approach described below. With more brittle siding panels, smaller face exposure or face nailing is generally required for high load areas.

In the face nailing method shown by panel assembly 10 of FIG. 1, the first siding panel 14*a* is properly aligned on the wall 12. A second siding panel 14*b* is then aligned overlapping the first siding panel 14*a*, as described above, and a nail 18*a* is driven through both siding panels 14*a*, 14*b*, exposing the head of the nail 18*a* at the exterior surface of the second siding panel 14*b*. This process is repeated with subsequent siding courses, such as panels 14*c* and 14*d* shown in FIG. 1, using nails 18*b* and 18*c*. This method provides greater wind load resistance because each panel is secured by twice as many nails when compared with the blind nail method described above, i.e., each nail is driven through two panels (e.g., panels 14*a*, 14*b*) as opposed to just one panel.

There is a growing concern in the siding industry regarding "rainscreen." Rainwater penetration in a wall surface is a concern with any siding product, particularly in high storm areas. This penetration can cause rotting and decay and has been identified as the cause of massive condominium failures in regions such as Nova Scotia. Generally, there must be three factors present for leakage to occur: (1) water must be present; (2) an opening in the wall must be present; and (3) there must be some kind of force present to move the water through the opening. The above-described face nail and blind nail installations tend to pull the top panel onto the overlapped panel to create a fairly tight overlap. This overlap can cause a pressure imbalance between the outer and inner surfaces of the overlapping panels, thereby providing the force necessary to draw water into the assembly towards the wall. A related issue is draining water away from the wall once it penetrates the assembly.

These concerns have engendered the use of vertical furring strips in installing clapboard siding panel assemblies. The siding panels are installed onto the furring strips over some form of water barrier, such as building paper. The furring strips act to slightly separate the rear face of the siding panels from the wall, creating a slight air gap that helps to equalize air pressure on the front, exterior and rear, interior faces of the siding panels. This helps reduce the amount of moisture that is pulled to the rear face of the siding panel, which can lead to moisture-related problems such as mold growth or wall rotting stemming from collected water or moisture. This gap, which is created by the furring strips, also provides for a rain drip or weep, which helps remove water from behind the rear face of the siding panels. The use of furring strips, however, is not without its disadvantages, including increased installation costs due to the extra materials and the cumbersome installation process.

In light of the above, there is a need for a new siding panel system and panel configuration that allow for ease of installation while providing rainscreen and water drainage.

SUMMARY OF THE INVENTION

A generally rectangular siding panel having a front and rear faces is provided. The siding panel has one or more protrusions spaced along at least one of the faces, wherein the protrusions provide an air gap between the siding panel and a face of a second siding panel when the siding panels are installed in a siding panel assembly.

The designed air gap allows for air flow between overlapping panels, thereby helping to promote air circulation between the panels. This circulation promotes pressure equalization between the front and rear faces of the siding panel and eliminates a factor known to contribute to rain penetration.

A generally rectangular siding panel having a front and rear faces is also provided where the siding panel has one or more recesses or cuts spaced along at least one of the faces, wherein the recesses or cuts provide an air flow path between the siding panel and a face of a second siding panel when the siding panels are installed in a siding panel assembly.

The designed air flow path between overlapping siding panels helps to promote air circulation between the panels. This circulation promotes pressure equalization between the front and rear faces of the siding panel and eliminates a factor known to contribute to rain penetration.

The above and other features of the present invention will be better understood from the following detailed description of the preferred embodiments of the invention that is provided in connection with the accompanying drawings.

BRIEF DESCRIPTION OF THE DRAWINGS

The accompanying drawings illustrate preferred embodiments of the invention, as well as other information pertinent to the disclosure, in which.

DETAILED DESCRIPTION

Figure 1:
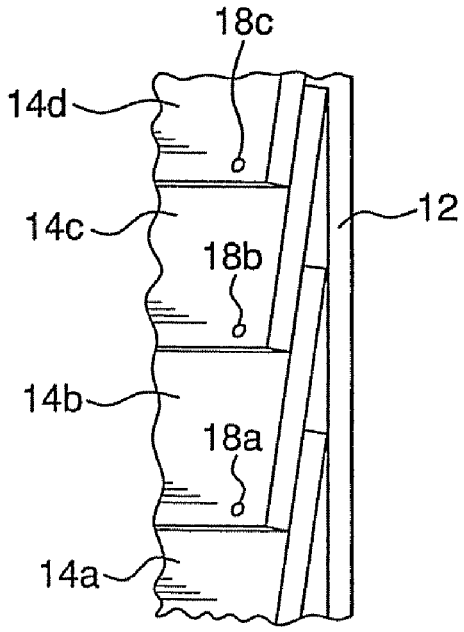
FIG. 1 (PRIOR ART)
FIG. 1 is a partial perspective view of a prior art face nail clapboard panel assembly.
Figure 2:
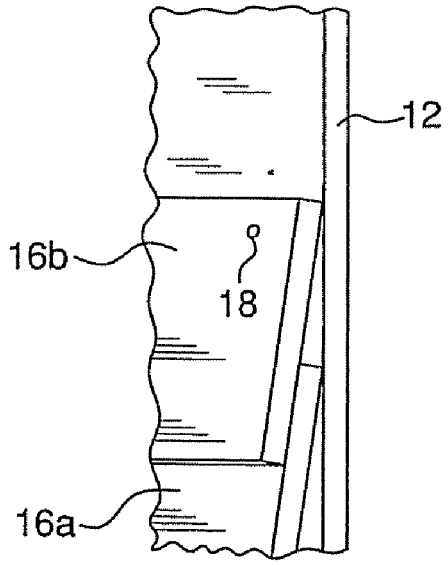
FIG. 2 (PRIOR ART)
FIG. 2 is a partial perspective view of a prior art blind nail clapboard panel assembly.
Figure 3:
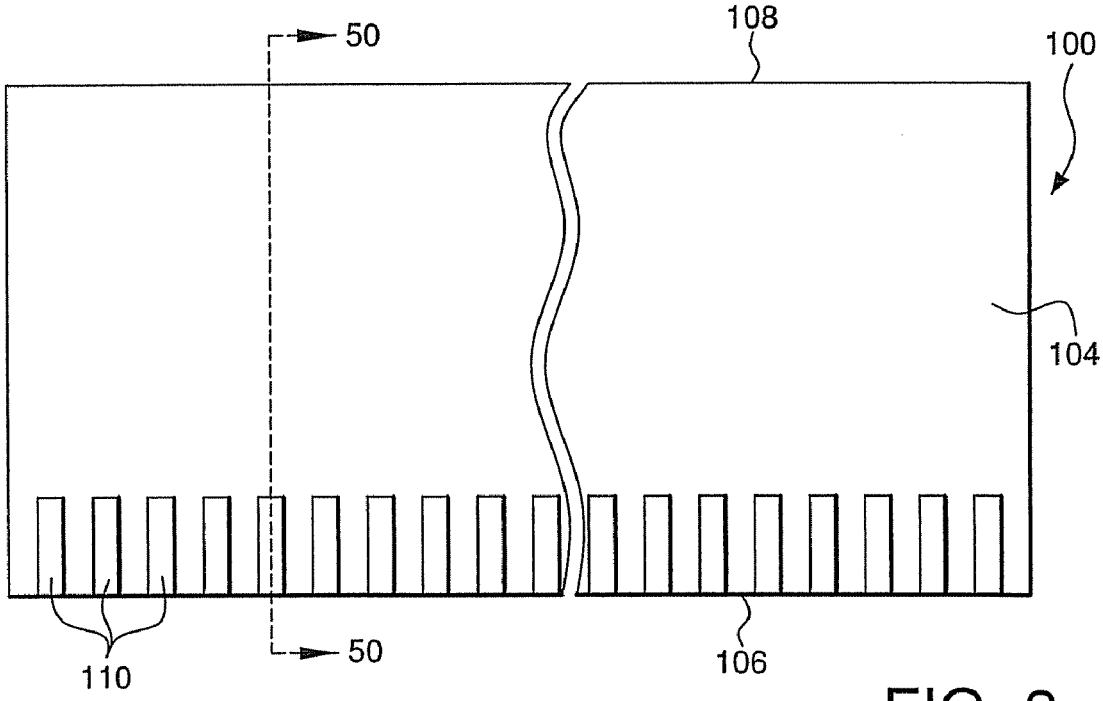
FIGS. 3-3B illustrate an embodiment of an exemplary siding panel and a panel assembly that provides for an air gap between the panels.
Figure 3A:
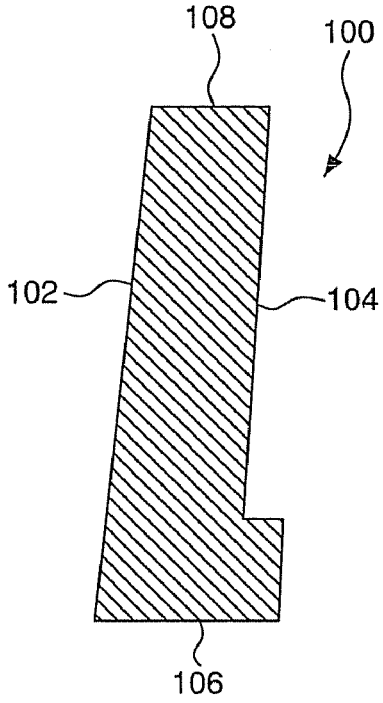
FIG. 3C illustrates an embodiment of a panel assembly installed using a blind nail method with nails disposed through the protrusions of the overlapped siding panel.
Figure 8:
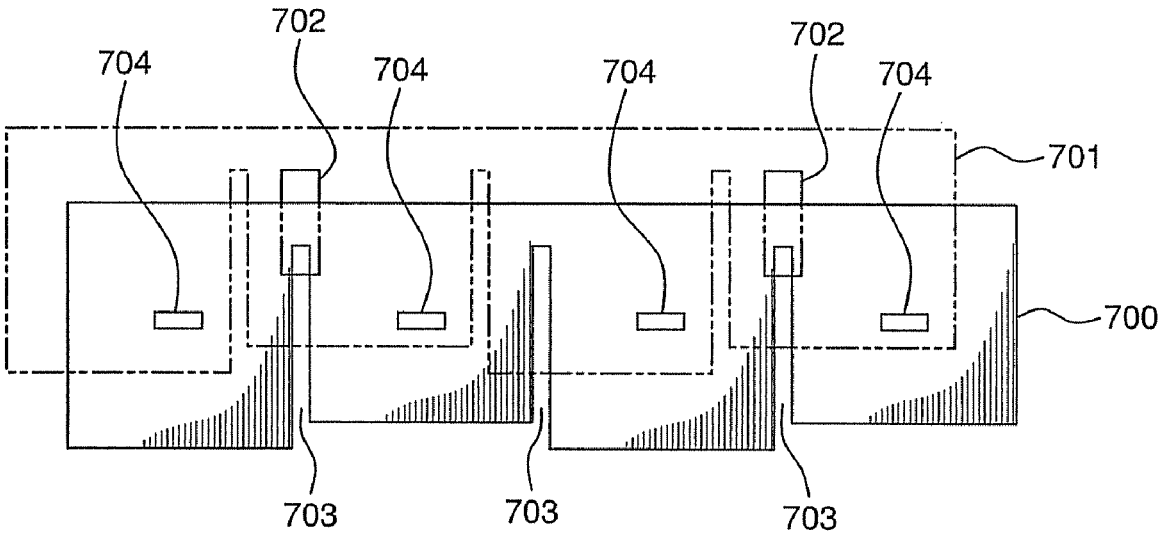
FIG. 8 is a front plan view of a siding panel, with an overlapping siding panel in phantom, depicting a combination of techniques for providing air flow between panels.

Referring first to FIG. 3, a rear elevational view of a first embodiment of a siding panel 100 is shown. A cross-sectional view of the panel 100 taken along lines 50-50 is shown in FIG. 3A. Siding panel 100 has a generally rectangular shape, and, in an exemplary embodiment, is a clapboard siding panel, preferably a fiber cement clapboard siding panel. Siding panel 100 has front and rear faces 102 and 104, respectively. In one embodiment, the siding panel may be between about 12'-16' in length, as is conventional, with faces about 10" in height. The siding panel has a thickness typically between about ⅛to ½", and preferably around 3⁄16". In one exemplary embodiment shown in the rear elevational view of FIG. 3 and the cross-sectional view of FIG. 3A, the panel 100 includes at least one, and preferably a plurality, of protrusions 110 located proximate to the bottom edge 106 of the panel and extending from the rear face 104. It should be understood, however, that the spaced protrusions 110 may extend from the rear face 104 proximate to the bottom edge 106 of the panel 100 and/or from the front face 102 proximate to the top edge 108 of the panel 100 (not shown). The protrusions 110 are preferably oriented substantially vertical to the bottom edge 106, i.e., perpendicular to the bottom edge, but may vary as much as ±85° from vertical. It is contemplated that horizontally oriented, spaced protrusions may also be employed, such as protrusions 704 shown in FIG. 8 discussed below. The protrusions preferably have a height of around 1"-3", corresponding to the overlap between panels in a panel assembly, and extend a distance away from the rear or front face a distance sufficient to provide air circulations as described below and that is generally aesthetically pleasing. In one embodiment, the panel has a thickness of about ⅛ to ½", and preferably around 3⁄16".

Figure 3B:
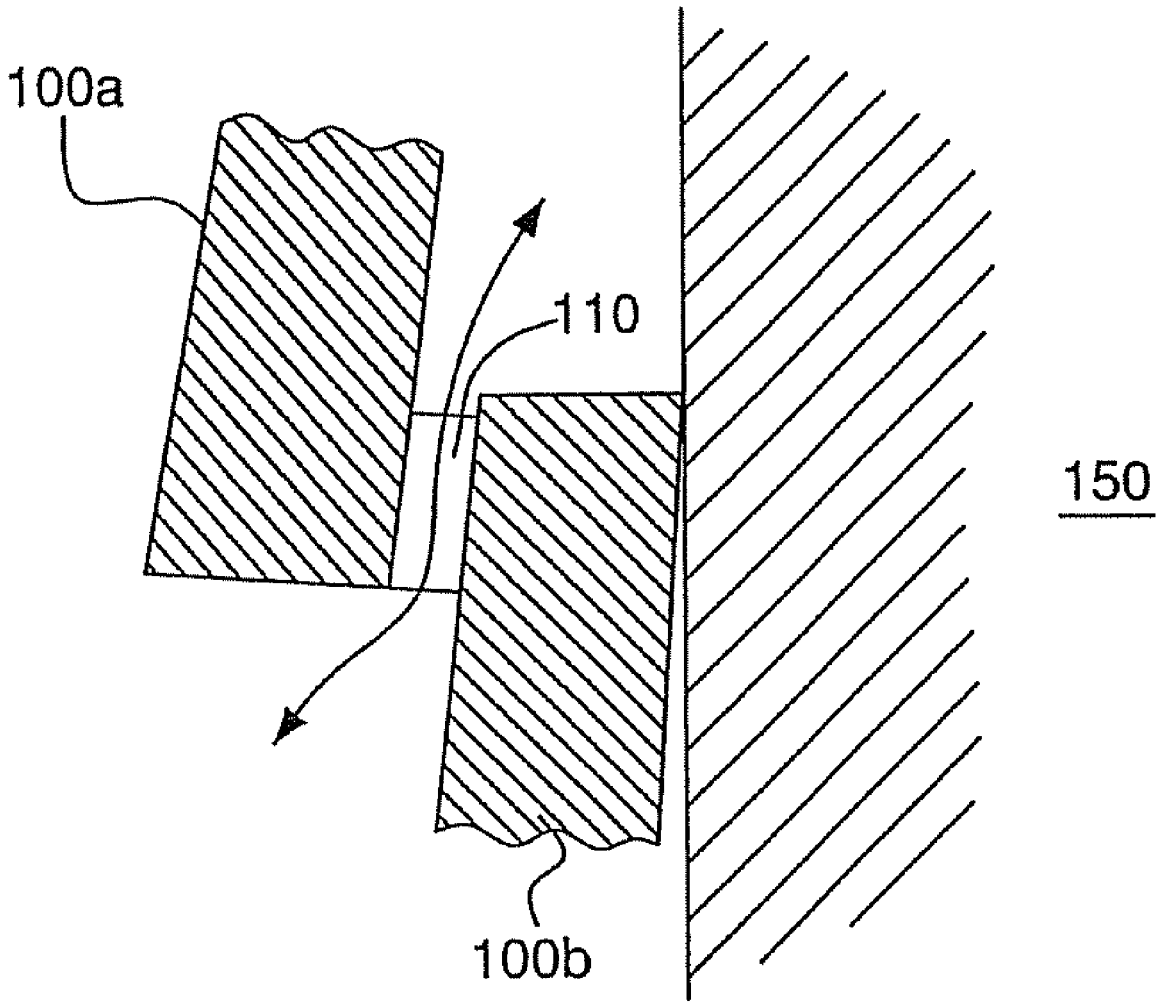

FIG. 3B illustrates an exemplary siding panel assembly having at least two overlapping siding panels 100*a*, 100*b*. Siding panel 100*a* partially overlaps the front face of siding panel 100*b*. It should be understood that the siding panels 100*a*, 100*b* may be attached to a wall 150 in several different manners, for example in the face or blind nail methods described above in the "Background of the Invention" section. Similar panels are preferably, but not necessarily, used to form the assembly, i.e., both panels preferably have their respective protrusions 110 located on either their front or rear faces as described above. The panels 100*a*, 100*b* overlap such that the protrusions 110 of panel 100*a* contact the front face of panel 100*b*, thereby separating the rear face of panel 100*a* from the front face of panel 100*b*. The space provided between the individual protrusions provides for an air gap between the rear face of panel 100*a* and the front face of panel 100*b*. This air gap allows for air flow between the protrusions and, therefore, between the panels 100*a*, 100*b*, as generally shown by the arrow of FIG. 3B. This forced air gap helps promote air circulation between the panels 100*a*, 100*b*, thereby promoting pressure equalization between the front and rear faces of panel 100*a* and eliminating a factor known to contribute to rain penetration.

Figure 4:
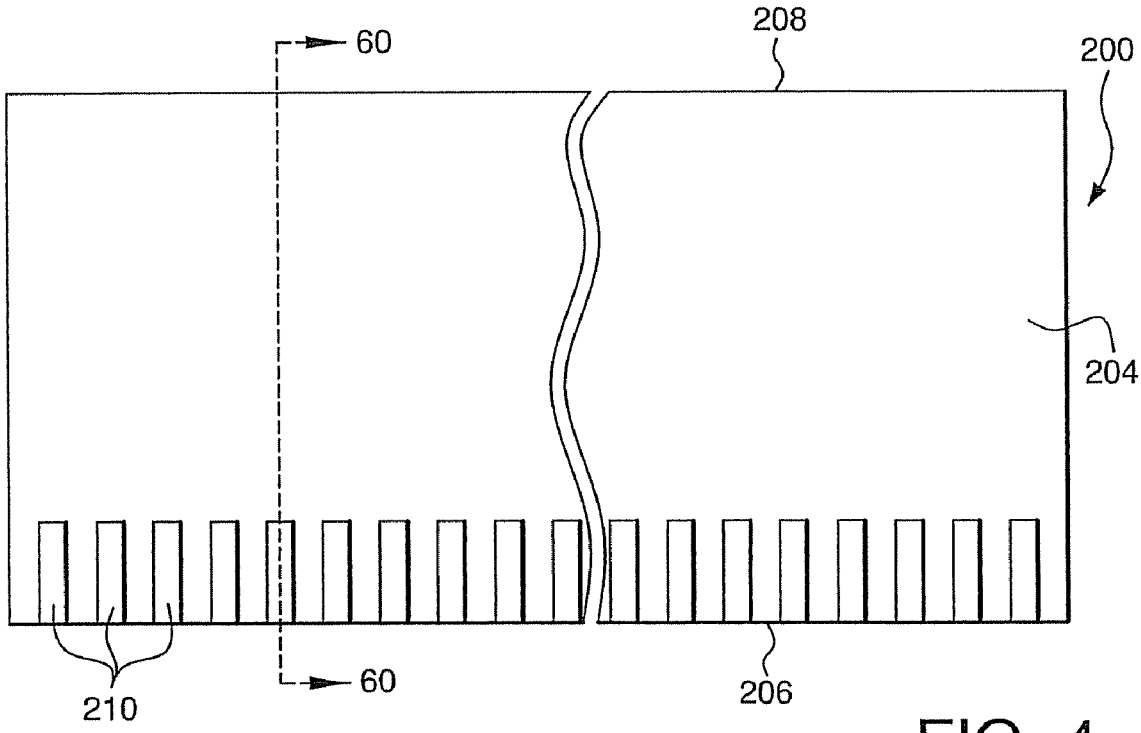
FIGS. 4-4B illustrate an embodiment of an exemplary siding panel and a panel assembly that provides an air flow path between the panels.
Figure 4A:
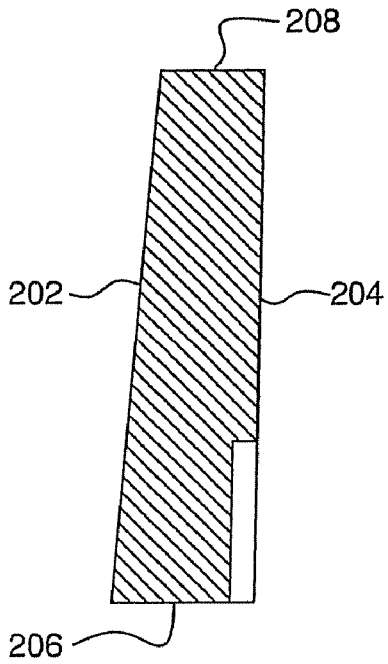

FIGS. 4-4C illustrate a second embodiment of a siding panel and siding panel assembly that creates an air flow path that provides for pressure equalization as described above. FIG. 4 is a rear elevational view of a siding panel 200. FIG. 4A is a cross sectional view of the panel 200 taken along line 60-60 of FIG. 4. Like panel 100, siding panel 200 has a generally rectangular shape, and, in an exemplary embodiment, is a clapboard siding panel, preferably a fiber cement clapboard siding panel. Siding panel 200 has front and rear faces 202 and 204, respectively. In the embodiment shown in the rear elevational view of FIG. 4 and the cross-sectional view of FIG. 4A, the panel 200 includes at least one, and preferably a plurality, of recesses 210 that are located proximate to the bottom edge 208 of the panel 200 and within the rear face 204. It should be understood, however, that a plurality of spaced recesses 210 may be formed within the rear face 204 proximate to the bottom edge 206 of the panel 200 and/or within the front face 202 proximate to the top edge 208 of the panel 200. Alternatively, the recesses can be a substituted by a cutout 703 through the panel 700, such as an extended cut or removed portion forming a seam between adjacent shakes in a panel shown in FIG. 8. Cutouts 703, recesses 702 and protrusions 704 can be used in combination to help promote pressure equalization and minimize rain-screening. The recesses 210 are preferably disposed in a substantially vertical orientation relative to the bottom edge 206, i.e., perpendicular to the bottom edge 206, but may vary as much as ±85° from vertical.

Figure 4B:
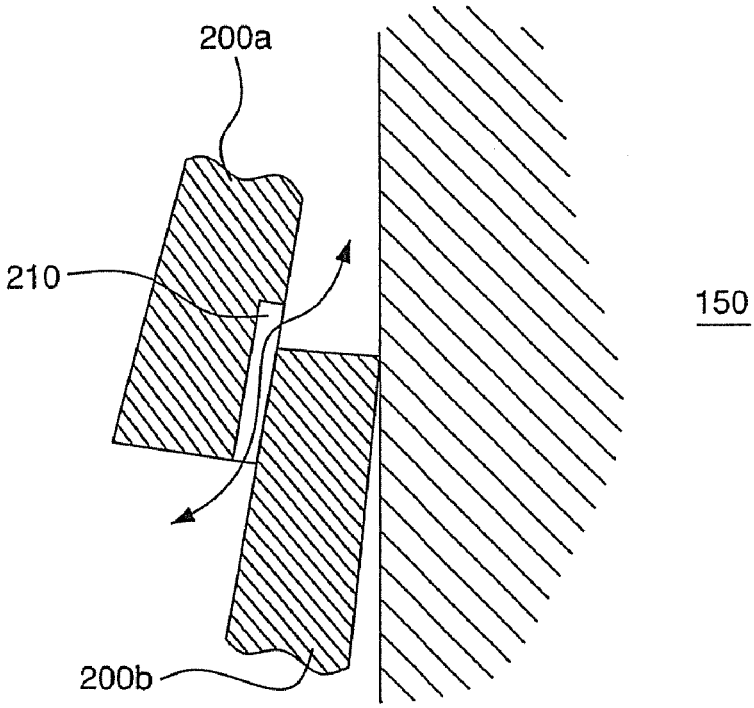

FIG. 4B illustrates an exemplary siding panel assembly having at least two overlapping siding panels 200*a*, 200*b*. The rear face of siding panel 200*a* partially overlaps the front face of siding panel 200*b*. It should be understood that the siding panels may be attached to a wall 150 in several different manners, such as by the face or blind nail methods described above in the "Background of the Invention" section. Similar panels are preferably, but not necessarily, used to form the assembly, i.e., both panels preferably have their respective recesses 210 located on either their front or rear faces. The panels 200*a*, 200*b* overlap such that the recesses 210 of panel 200*a* overlap the front face of panel 200*b*, thereby providing an air flow path between the rear face of panel 200*a* and the front face of panel 200*b*. The recesses 210 are sized, and/or the overlap between the panels 200*a*, 200*b* is selected, such that the air flow path (shown generally by the arrows in FIG. 4B) is created, i.e., such that an entry and exit points for the air flow are provided. This air flow path helps promote air circulation between the panels 200*a*, 200*b*, thereby promoting pressure equalization between the front and rear faces of panel 200*a* and eliminating a factor known to contribute to rain penetration.

Figure 5:
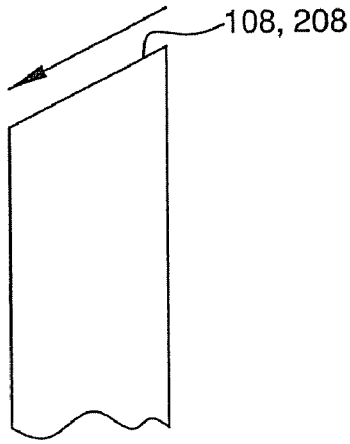
FIG. 5 is a side elevational view of an embodiment of a siding panel having a sloped top edge.

Referring to FIG. 5, a partial, side elevational view of an embodiment of panels 100, 200 is shown with a top edge configured to promote rain drip or weep. In this embodiment, the top edge 108 or 208 of the siding panel 100 or 200, respectively, is sloped downward from the rear face 104 or 204 to the front face 102 or 202. This slope helps funnel water (represented by the arrow of FIG. 5) that has accumulated between a wall 150 and the rear faces of the panels in an assembly away from the wall and out of the siding panel assembly through an air gap formed by protrusions 110 of panels 100 or and air flow path formed by recesses 210 of panels 200.

Figure 6:
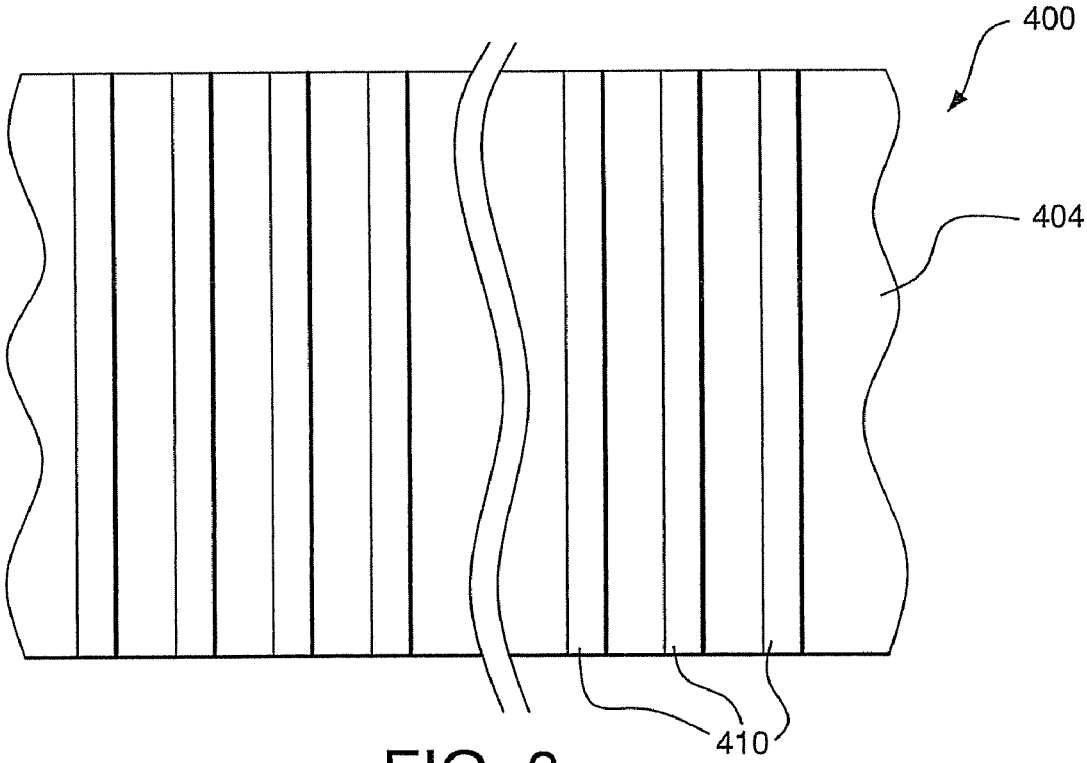
FIG. 6 is a partial rear elevational view of an alternative embodiment of the siding panel illustrated in FIGS. 3-3B.
Figure 7:
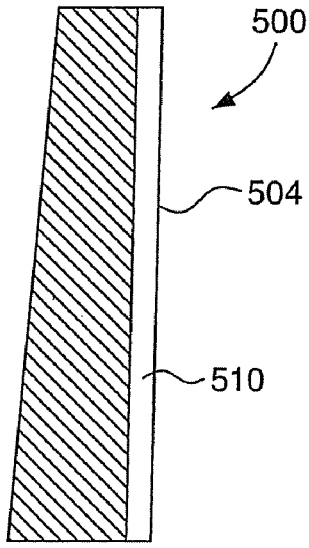
FIG. 7 is a cross-sectional view of an alternative embodiment of the siding panel illustrated in FIGS. 4-4B.

Referring to FIG. 6, a partial rear elevational view of an alternative embodiment of the panel 100 of FIG. 3 is shown. Panel 400 of FIG. 6 is identical to panel 100 of FIG. 3, only protrusions 410 extend along all or substantially all (i.e., more than 50%, and preferably more than 75%) of the rear face 404 of the panel 400. These extended vertical protrusions 410 are disposed to contact a wall 150 in a siding panel assembly, thereby promoting an air gap not only between overlapping panels 400, but also between the wall 150 (or siding product covering the wall 150 (e.g., insulation or moisture barrier)) and the panels 400. This feature promotes pressure equalization between the surface of wall 150 and each panel in the panel assembly, thereby further reducing rain penetration and providing a rain drip or weep region. It should be noted that a similar effect can be achieved by extending the recesses of the panel embodiment of FIG. 4 along the entire rear face of the siding panel. This embodiment is shown in the cross sectional view of a siding panel 500 in FIG. 7 having vertically extending recesses 510 along the rear face 504 of panel 500.

Although the siding panels illustrated herein are described as clapboard fiber cement siding panels, this is by no means a requirement. One of ordinary skill will realize that siding panels may be fabricated from a variety of materials other than fiber cement, such as wood or plastic, such as PVC, or composites thereof. It should also be apparent that, although not illustrated, the siding panel assemblies described herein may include other products typically included in panel assemblies, such as sheathing, air and water barriers and insulation.

Fabrication of the panels 100, 200 having protrusions 110 or recesses 210 described above may be accomplished using fabrication techniques known for manufacturing fiber cement or other clapboard siding panels. For example, the recess or protrusion shapes can simply be incorporated into the press contour, grain, or grooves between shakes, used to fabricate fiber cement clapboard siding panels. This process is often referred to as "Post Press." Alternatively, an accumulator roll process, for example, may be utilized.

Figure 3C:
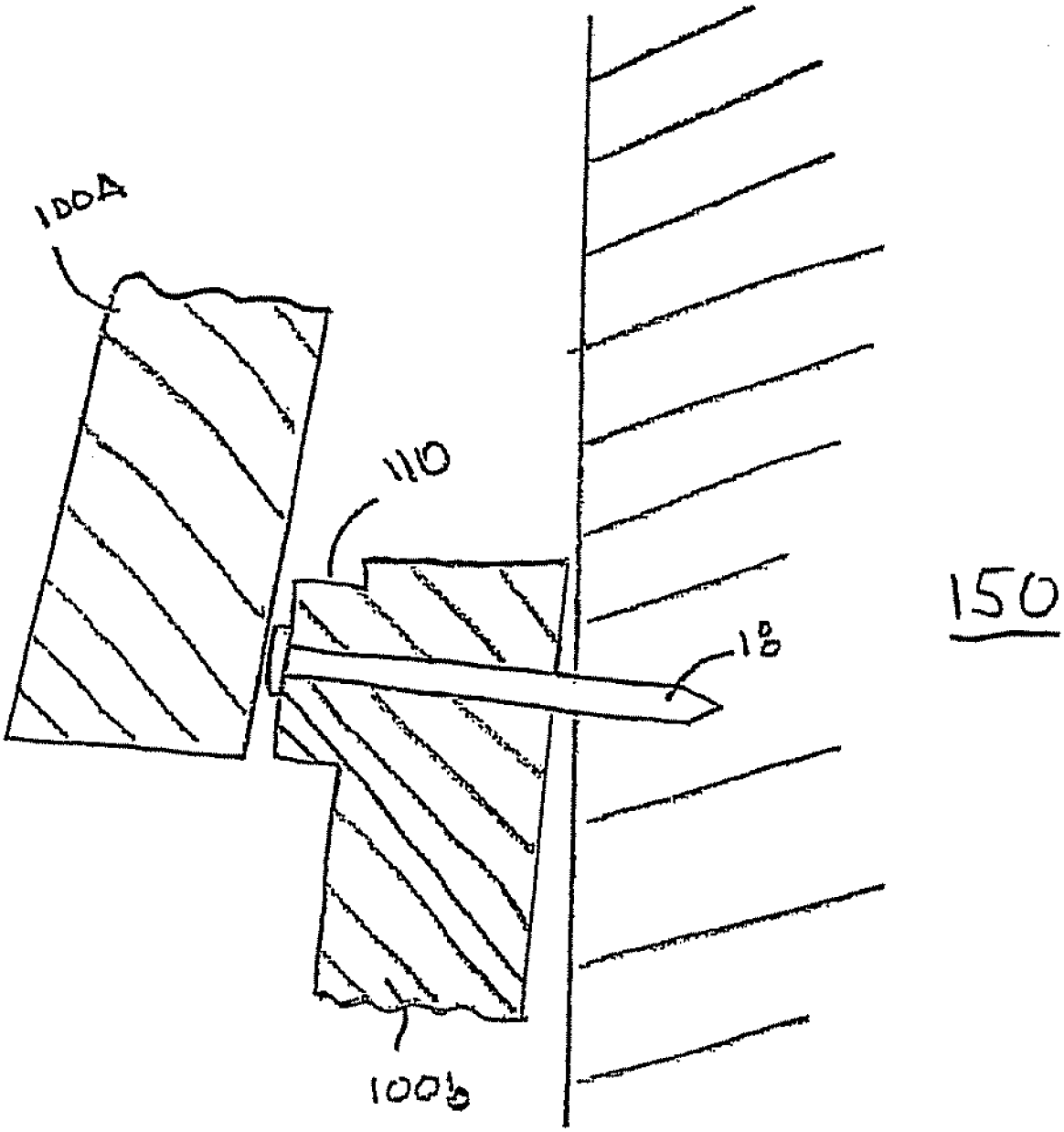

A method of installing a siding panel assembly on a structure is also provided herein. First and second siding panels are provided. At least one of the siding panels is configured like a siding panel 100 described above, i.e., it has a plurality of protrusions 110 spaced along at least one of its respective front and rear faces 102, 104. The siding panels are attached to the structure such that a rear face of one siding panel partially overlaps a front face of the other siding panel so that the protrusions 110 provide an air gap between the first and second siding panels. Preferably, this process is repeated until the structure is covered with siding panels. A blind nail or a face nail process may be utilized to attach the siding panels. In one embodiment, a blind nail method is used and the siding panels have protrusions 110 located on the front face 102 of the panels 100 and proximate to the top edge 108. The protrusions 110 are spaced such that they may be used as nailing marks. For example, the protrusions 110 may be located at positions every 12" or 16", or other spacing for load bearing studs in a wall 150. These nails are then driven through the protrusions, as shown in FIG. 3C, into the load bearing studs of a wall 150. The nail head extending from the protrusions 110 can also serve as an additional means of providing a forced gap between the rear face of an overlapping siding panel and the front face of an overlapped siding panel. The spaced protrusions can also serve as markings for cutting the siding panels into predefined lengths.

In a second method of installing a siding panel assembly on a structure, first and second siding panels are provided. At least one of the siding panels is configured like a siding panel 200 described above, i.e., it has a plurality of recesses 210 spaced along at least one of its respective front and rear faces 202, 204. The siding panels are attached to the structure such that a rear face of one siding panel partially overlaps a front face of the other siding panel so that the recesses 210 provide an air flow path between the first and second siding panels. Preferably, this process is repeated until the structure is covered with siding panels. A blind nail or a face nail process may be utilized to attach the siding panels.

Although the invention has been described in terms of exemplary embodiments, it is not limited thereto. For example, the concepts described herein may also be applied to starter strips used to provide air circulation regions behind a starter strip used in connection with a clapboard panel assembly, thereby improving the effectiveness of the entire assembly. Rather, the appended claims should be construed broadly to include other variants and embodiments of the invention that may be made by those skilled in the art without departing from the scope and range of equivalents of the invention.

What is claimed is:

1. A method of installing siding panel on a vertical wall of a structure, comprising the following steps:

providing first and second clapboard siding panels, each of said siding panels having front and rear faces, at least one of said siding panels having at least one spacing element formed integrally with said siding panel and disposed along at least one of said faces; and attaching said siding panels to said wall of said structure to form a partially overlapping siding panel assembly comprising an overlapping siding panel and an overlapped siding panel, wherein said at least one spacing element provides an air gap or air flow path between said siding panels in an overlap region, said air gap or air flow path positioned to be effective in minimizing a pressure differential between the front face of said overlapped siding panel and the rear face of said overlapping siding panel in said partially overlapping siding panel assembly.

2. The method of claim 1, wherein said at least one spacing element comprises a plurality of spaced spacing elements.

3. The method of claim 2, wherein said plurality of spaced spacing elements comprises a plurality of spaced protrusions.

4. The method of claim 3, wherein:

said attaching step utilizes a blind nail attachment method, and said protrusions are spaced along and proximate to a top edge of said front face of said overlapped siding panel, said method further comprising the step of disposing fasteners through said protrusions to attach said overlapped siding panel to said structure.

5. The method of claim 4, wherein said protrusions are located at positions along said front face of said overlapped siding panel corresponding to studs located in said structure.

6. The method of claim 2, wherein said spacing elements are disposed proximate to a bottom edge and at said rear face of said overlapping siding panel or proximate to a top edge and at said front face of said overlapped siding panel.

7. The method of claim 1, wherein said clapboard siding panels are fiber cement clapboard siding panels.

8. The method of claim 1, wherein a top edge of said overlapped siding panel slopes downward from said rear face to said front face.

9. The method of claim 1, wherein each of said siding panels comprises a plurality of spacing elements disposed proximate to a respective bottom edge and at said rear face of said siding panel or proximate to a respective top edge and at said front face of said siding panel.

10. The method of claim 1, wherein said at least one spacing element comprises at least one of a protrusion, a recess or a cut in at least one of said faces of said siding panel.

11. The method of claim 10, wherein said at least one spacing element comprises a plurality of spacing elements comprising at least one of a plurality of protrusions, a plurality of recesses or a plurality of cuts.

12. The method of claim 1, wherein said at least one spacing element comprises at least one molded impression.

13. The method of claim 1, wherein said at least one spacing element comprises a plurality of spacing elements hidden in said overlap region when viewed from said front faces, said plurality of spacing elements at least partially separating said siding panels.

14. A method of installing siding panel on a vertical wall of a structure, comprising the following steps:

providing at least one clapboard siding panel, said siding panel having front and rear faces, said siding panel including a plurality of spacing elements formed integrally with said siding panel and disposed along said rear face; and attaching said siding panel to said wall of said structure with at least a portion of said spacing elements in contact with a surface of said vertical wall, wherein said spacing elements provide an air gap or air flow path between said vertical wall of said structure and said siding panel effective in minimizing a pressure differential between said vertical wall and said siding panel.

15. The method of claim 14, wherein said spacing elements are disposed proximate to a top edge of said rear face of said siding panel.

16. The method of claim 14, wherein said spacing elements comprise a plurality of spaced protrusions, said protrusions disposed to separate said siding panel from a surface of said vertical wall.

17. The method of claim 14, wherein said spacing elements comprise a plurality of recesses or cuts in said rear face of said siding panel.

18. The method of claim 14, comprising the step of providing a plurality of said at least one siding panel and attaching said plurality of siding panels to said wall in a partially overlapping siding panel assembly comprising an overlapped siding panel and an overlapping siding panel.

19. The method of claim 18, wherein at least one of said overlapping and overlapped siding panels comprises at least one second spacing element formed integrally with said siding panel and disposed along at least one of said faces, wherein said at least one second spacing element provides an air gap or air flow path between said siding panels in an overlap region, said air gap or air flow path positioned to be effective in minimizing a pressure differential between the front face of said overlapped siding panel and rear face of said overlapping siding panel in said partially overlapping siding panel assembly.

20. The method of claim 19, wherein said at least one second spacing element comprises a plurality of second spacing elements.

21. The method of claim 20, wherein said plurality of second spacing elements comprises a plurality of spaced protrusions disposed proximate to a bottom edge and at said rear face of said overlapping siding panel or proximate to a top edge and at said front face of said overlapped siding panel.

* * * * *